US011242857B2

(12) United States Patent
Martignago et al.

(10) Patent No.: US 11,242,857 B2
(45) Date of Patent: Feb. 8, 2022

(54) CENTRIFUGAL TURBO-COMPRESSOR

(71) Applicants: Robert Bosch GmbH, Stuttgart (DE); Danfoss Commercial Compressors, Trévoux (FR)

(72) Inventors: Clement Martignago, Miserieux (FR); Patrice Bonnefoi, Saint Didier au mont d'or (FR); Stan Vandesteene, Lyons (FR); Yves Rosson, Villars les Dombes (FR)

(73) Assignees: Robert Bosch GmbH, Stuttgart (DE); Danfoss Commercial Compressors, Trévoux (FR)

( * ) Notice: Subject to any disclaimer, the term of this patent is extended or adjusted under 35 U.S.C. 154(b) by 204 days.

(21) Appl. No.: 16/492,192

(22) PCT Filed: Mar. 8, 2018

(86) PCT No.: PCT/EP2018/055816
§ 371 (c)(1),
(2) Date: Sep. 9, 2019

(87) PCT Pub. No.: WO2018/162667
PCT Pub. Date: Sep. 13, 2018

(65) Prior Publication Data

US 2020/0011334 A1 Jan. 9, 2020

(30) Foreign Application Priority Data

Mar. 8, 2017 (FR) ..... 1751910

(51) Int. Cl.
*F04D 17/12* (2006.01)
*F04D 29/046* (2006.01)
*F04D 29/16* (2006.01)

(52) U.S. Cl.
CPC ..... *F04D 17/122* (2013.01); *F04D 29/046* (2013.01); *F04D 29/162* (2013.01);
(Continued)

(58) Field of Classification Search
CPC .... F04D 17/122; F04D 29/046; F04D 29/162; F04D 29/102; F04D 29/0513;
(Continued)

(56) References Cited

U.S. PATENT DOCUMENTS 7,240,515 B2 * 7/2007 Conry ..... F04D 25/06 62/510
7,568,883 B2 * 8/2009 Arnold ..... F04D 17/122 415/100

(Continued)

FOREIGN PATENT DOCUMENTS

CN 105121863 12/2015
CN 105308331 A 2/2016

(Continued)

OTHER PUBLICATIONS

International Search Report for Application No. PCT/EP2018/055816 dated Jun. 20, 2018 (3 pages).

*Primary Examiner* — Brian P Wolcott
(74) *Attorney, Agent, or Firm* — Michael Best & Friedrich LLP

(57) ABSTRACT

The centrifugal turbo-compressor (2) includes a hermetic casing; a drive shaft (6); a first and a second compression stage (12, 13) configured to compress a refrigerant and respectively including a first and a second impeller (18, 19) connected to the drive shaft (6) and being arranged in a back-to-back configuration; an interstage sealing device provided between the first and second impellers (18, 19). The hermetic casing includes a main casing portion (4) in which are arranged the first and second compression stages (Continued)

(12, 13) and the inter-stage sealing device. The first and second compression stage (12, 13) respectively includes a first and a second aerodynamic member (29, 31) each having an annular disc shape and respectively facing front-sides (21, 22) of the first and second impellers (18, 19).

18 Claims, 4 Drawing Sheets

(52) U.S. Cl.
CPC ..... *F05B 2240/14* (2013.01); *F05B 2240/50* (2013.01); *F05B 2240/57* (2013.01)

(58) Field of Classification Search
CPC ..... F04D 29/624; F05B 2240/14; F05B 2240/50; F05B 2240/57
See application file for complete search history.

(56) References Cited

U.S. PATENT DOCUMENTS

| | | | | |
|---|---|---|---|---|
| 10,619,645 | B2 * | 4/2020 | Daussin | F04D 29/102 |
| 10,794,390 | B2 * | 10/2020 | Bonnefoi | F02C 7/275 |
| 10,968,919 | B2 * | 4/2021 | Sishtla | F04D 29/058 |
| 2015/0267717 | A1 * | 9/2015 | Fujii | F16C 17/024 415/220 |

FOREIGN PATENT DOCUMENTS

| | | | | |
|---|---|---|---|---|
| JP | H03272317 | A | 12/1991 | |
| JP | H03277807 | A | 12/1991 | |
| JP | H062693 | A | 1/1994 | |
| JP | H11148492 | A | 6/1999 | |
| JP | 11294879 | | 10/1999 | |
| JP | 2000240596 | A | 9/2000 | |
| JP | 2002070847 | A | 3/2002 | |
| JP | 2005519241 | A | 6/2005 | |
| SU | 844824 | A1 | 7/1981 | |
| WO | WO-0075490 | A1 * | 12/2000 | F01D 9/048 |
| WO | 2015019901 | A1 | 2/2015 | |
| WO | 2016024409 | | 2/2016 | |
| WO | 2016193002 | A1 | 12/2016 | |
| WO | WO-2016193002 | A1 * | 12/2016 | H02K 5/1677 |
| WO | 2017005477 | A1 | 1/2017 | |

* cited by examiner

CENTRIFUGAL TURBO-COMPRESSOR

FIELD OF THE INVENTION

The present invention relates to a centrifugal turbo-compressor, and particularly to a double-stage centrifugal turbo-compressor.

BACKGROUND OF THE INVENTION

As known, a double-stage centrifugal turbo-compressor notably includes:

- a hermetic casing,
- a drive shaft rotatably arranged within the hermetic casing and extending along a longitudinal axis,
- an one-piece impeller member connected to the drive shaft and including a first impeller and a second impeller, each of the first and second impellers having a front-side and a back-side, the first and second impellers being arranged in a back-to-back configuration,
- a radial annular groove formed between the back-sides of the first and second impellers,
- an inter-stage sealing device provided between the first and second impellers, the inter-stage sealing device including two separated sealing members each having a half-disc shape and being at least partially arranged within the radial annular groove,
- a radial bearing arrangement configured to rotatably support the drive shaft, and
- an axial bearing arrangement configured to limit an axial movement of the drive shaft during operation.

Particularly, the first impeller and an annular aerodynamic member located in the hermetic casing define a first compression stage, while the hermetic casing and the second impeller define a second compression stage.

A main objective for such a centrifugal turbo-compressor is to keep substantially unchanged, for all operating conditions of the latter (for different temperature cycles and different rotation speeds), the axial and radial functional clearances between the one-piece impeller member, the annular aerodynamic member and the hermetic casing.

The achievement of such a main objective requires a high level of machining accuracy for manufacturing the one-piece impeller member, the annular aerodynamic member, the hermetic casing and also the axial bearing arrangement, which substantially increases the manufacturing cost of such a centrifugal turbo-compressor. Further, the assembly of such a centrifugal turbo-compressor is difficult, since it requires a lot of re-machining and adjustments of various parts constituting the centrifugal turbo-compressor to guarantee appropriate axial and radial functional clearances.

Further such a configuration of the inter-stage sealing device may lead to undesirable fluid leakage particularly between the sealing members. Therefore the manufacture of the above-mentioned inter-stage sealing device requires a high level of machining accuracy in order to limit said undesirable fluid leakage. The control of the sealing between the two compression stages of the above-mentioned double-stage centrifugal turbo-compressor is thus difficult due to said configuration of the inter-stage sealing device.

SUMMARY OF THE INVENTION

It is an object of the present invention to provide an improved centrifugal turbo-compressor which can overcome the drawbacks encountered in conventional centrifugal turbo-compressor.

Another object of the present invention is to provide a reliable and easy to manufacture and to assemble centrifugal turbo-compressor and having a reduced manufacturing cost.

According to the invention such a centrifugal turbo-compressor includes:

- a hermetic casing,
- a drive shaft rotatably arranged within the hermetic casing,
- a radial bearing arrangement configured to rotatably support the drive shaft,
- a first and a second compression stage configured to compress a refrigerant, the first and second compression stages respectively including a first and a second impeller, each of the first and second impellers having a front-side and a back-side, the first and second impellers being connected to the drive shaft and being arranged in a back-to-back configuration,
- an inter-stage sealing device provided between the first and second impellers, characterized in that the first and second compression stage respectively includes a first and a second aerodynamic member, the first and second aerodynamic members each having an annular disc shape and respectively facing the front-sides of the first and second impellers, and in that the hermetic casing includes a main casing portion in which are arranged the first and second compression stages and the inter-stage sealing device.

Due to said configuration of the hermetic casing, and notably due to the provision of a second aerodynamic member distinct from the hermetic casing, the manufacture of the hermetic casing of the centrifugal turbo-compressor according to the invention requires a low level of machining accuracy, which substantially reduces the manufacturing cost of such a centrifugal turbo-compressor and substantially eases the assembly of such a centrifugal turbo-compressor. Particularly, such a configuration of the hermetic casing reduces, or at least eases, the required re-machining steps of the internal parts constituting the centrifugal turbo-compressor to guarantee appropriate axial and radial functional clearances.

Further, the hermetic casing may be configured to have an axial flexibility in order to at least partially compensate for thermal expansion occurring in the centrifugal turbo-compressor, and notably thermal expansion the first and second aerodynamic members and the inter-stage sealing device.

The centrifugal turbo-compressor may also include one or more of the following features, taken alone or in combination.

According to an embodiment of the invention, the first and second aerodynamic members and the inter-stage sealing device are secured to the radial bearing arrangement, such that the first and second aerodynamic members, the inter-stage sealing device and the radial bearing arrangement form a rigid sub-assembly.

According to an embodiment of the invention, the centrifugal turbo-compressor includes at least one securing element configured to secure the first and second aerodynamic members and the inter-stage sealing device to the radial bearing arrangement. For example, the at least one securing element may be a securing screw or a securing pin. According to an embodiment of the invention, the at least one securing element extends substantially parallely to the drive shaft.

According to an embodiment of the invention, the main casing portion includes a cylindrical main housing in which are arranged the first and second compression stages and the inter-stage sealing device.

According to an embodiment of the invention, the outer diameters of the inter-stage sealing device and of the second aerodynamic member are substantially equal to the inner diameter of the cylindrical main housing of the main casing portion.

According to another embodiment of the invention, the outer diameters of the inter-stage sealing device and of the second aerodynamic member could be different. For example, the main casing portion may include at least one annular shoulder configured to cooperate with one of the inter-stage sealing device and the second aerodynamic member.

According to an embodiment of the invention, the hermetic casing further includes a bearing casing portion having an axial bearing surface, the radial bearing arrangement abutting against the axial bearing surface of the bearing casing portion.

According to an embodiment of the invention, the centrifugal turbo-compressor further includes an elastic element arranged between the main casing portion and the second aerodynamic member, the elastic element axially biasing the first and second aerodynamic members, the inter-stage sealing device and the radial bearing arrangement with a predetermined force against the axial bearing surface of the bearing casing portion.

Such an elastic element allows, whatever the operating conditions of the centrifugal turbo-compressor, to keep the first and second aerodynamic members and the inter-stage sealing tightened together, and thus to keep substantially unchanged the axial functional clearances between the first and second impellers and the first and second aerodynamic members. Therefore the provision of such an elastic element ensures a high reliability to the centrifugal turbo-compressor according to the present invention.

Moreover the elastic element allows, notably when a thermal expansion occurs in the centrifugal turbo-compressor, an axial sliding of the first and second aerodynamic members and the inter-stage sealing device with respect to the hermetic casing, and thus avoids deformations of said parts which could lead to a shortened lifetime of the centrifugal turbo-compressor.

According to an embodiment of the invention, the elastic element is annular. Advantageously, the elastic element is arranged in an annular recess at least partially formed in an axial surface of the main casing portion. For example, the annular recess may also be partially formed in an axial surface of the second aerodynamic member.

According to an embodiment of the invention, the elastic element is an annular spring washer, for example of the Belleville type.

According to an embodiment of the invention, the inter-stage sealing device and the second aerodynamic member are axially slidably arranged in the cylindrical main housing. Advantageously, the first aerodynamic member is also axially slidably arranged in the cylindrical main housing.

According to an embodiment of the invention, the radial bearing arrangement is at least partially arranged in the bearing casing portion.

According to an embodiment of the invention, the centrifugal turbo-compressor further includes an axial bearing arrangement configured to limit an axial movement of the drive shaft during operation, the axial bearing arrangement including:

a first axial bearing plate having an annular disc shape, the first axial bearing plate having a first surface and a second surface opposite to the first surface of the first axial bearing plate, a second axial bearing plate having an annular disc shape, the second axial bearing plate having a first surface axially facing the first axial bearing plate and a second surface opposite to the first surface of the second axial bearing plate, a spacer ring clamped between the first surfaces of the first and second axial bearing plates at radial outer portions of the first and second axial bearing plates, the spacer ring defining an axial distance between the first and second axial bearing plates.

According to an embodiment of the invention, the drive shaft includes a radial flange portion extending into a space between radial inner portions of the first surfaces of the first and second axial bearing plates.

According to an embodiment of the invention, the radial bearing arrangement includes a bearing sleeve having an abutment surface, the second surface of the second axial bearing plate abutting against the abutment surface of the bearing sleeve.

According to an embodiment of the invention, the first and second aerodynamic members, and the inter-stage sealing device are secured to the bearing sleeve.

According to an embodiment of the invention, the bearing sleeve is at least partially arranged in the bearing casing portion and abuts against the axial bearing surface of the bearing casing portion.

According to an embodiment of the invention, the bearing casing portion includes a cylindrical bearing housing in which the bearing sleeve is at least partially arranged.

According to an embodiment of the invention, the outer diameter of the bearing sleeve is substantially equal to the inner diameter of the cylindrical bearing housing of the bearing casing portion.

According to an embodiment of the invention, the bearing sleeve is at least partially arranged in the cylindrical main housing of the main casing portion.

According to an embodiment of the invention, the bearing sleeve is clamped between the second axial bearing plate and the axial bearing surface of the bearing casing portion.

According to an embodiment of the invention, the centrifugal turbo-compressor further includes at least one elastic member axially biasing the first and second axial bearing plates and the spacer ring with a predetermined force against the abutment surface of the bearing sleeve. The provision of the at least one elastic member allows to create an independency between the clamping of the various elements forming the axial bearing arrangement, and the clamping of the first and second aerodynamic members and the inter-stage sealing device, and thus to control precisely the clamping force of the various elements forming the axial bearing arrangement.

According to an embodiment of the invention, the at least one elastic member includes an annular spring washer, for example of the Belleville type.

According to another embodiment of the invention, the at least one elastic member includes a plurality of coil springs angularly arranged around the drive shaft.

According to another embodiment of the invention, the coil springs are located between the first aerodynamic member and the first axial bearing plate.

According to an embodiment of the invention, the centrifugal turbo-compressor further includes an inlet distributor having an annular disc shape and adjacent to the first aerodynamic member, the inlet distributor being configured to supply, and for example to axially supply, the first aerodynamic member, and thus the first compression stage, with refrigerant.

According to an embodiment of the invention, the elastic element is configured to keep the first and second aerodynamic members, the inter-stage sealing and the inlet distributor tightened together.

According to an embodiment of the invention, the inlet distributor is axially slidably arranged in the hermetic casing, and for example in the cylindrical main housing.

According to an embodiment of the invention, the elastic element axially biases the first and second aerodynamic members, the inter-stage sealing device, the inlet distributor and the radial bearing arrangement, and particularly the bearing sleeve, with a predetermined force against the axial bearing surface of the bearing casing portion.

According to an embodiment of the invention, the centrifugal turbo-compressor further includes an annular spacing member clamped between the inlet distributor and the bearing sleeve. According to said embodiment, the elastic element may axially bias the first and second aerodynamic members, the inter-stage sealing device and the inlet distributor with a predetermined force against the annular spacing member.

According to an embodiment of the invention, the bearing sleeve may include an annular spacing part, and the elastic element may axially bias the first and second aerodynamic members, the inter-stage sealing device and the inlet distributor with a predetermined force against the annular spacing part.

According to an embodiment of the invention, the inlet distributor, the annular spacing member and the bearing sleeve define an annular receiving chamber in which are arranged, and for example axially slidably arranged, the first and second axial bearing plates and the spacer ring.

According to an embodiment of the invention, the first aerodynamic member is secured, and for example screwed, to the bearing sleeve.

According to another embodiment of the invention, the at least one elastic member is arranged in an annular recess formed in an axial surface of the inlet distributor.

According to another embodiment of the invention, each coil spring is arranged in a respective through hole provided in the inlet distributor.

According to an embodiment of the invention, the centrifugal turbo-compressor further includes an electric motor configured to drive in rotation the drive shaft about a rotation axis. Advantageously, the radial bearing arrangement and the thrust bearing arrangement are located between the electric motor and the first impeller.

According to an embodiment of the invention, the second impeller is distinct and separated from the first impeller so as to enable an adjustment of an axial distance between the back-sides of the first and second impellers. The fact that the first and second impellers are made from two separate and distinct pieces allows an adjustment of the axial distance between the back-sides of the first and second impellers during assembly of the double-stage impeller arrangement, and thus of the axial gaps required between the back-sides of the first and second impellers and the inter-stage sealing device, without requiring re-machining of the inter-stage sealing device. Moreover, two single stage impellers are easier to machine than a one-piece double stage impeller. Furthermore a better finish can be achieved especially on the back-sides of the first and second impellers when the latter are separately manufactured. Consequently, such a configuration of the first and second impellers improves the reliability of the centrifugal turbo-compressor and also reduces the manufacturing cost of the latter.

According to another embodiment of the invention, the centrifugal turbo-compressor includes a radial annular groove formed between the back-sides of the first and second impellers, the inter-stage sealing device being at least partially arranged within the radial annular groove.

According to another embodiment of the invention, the inter-stage sealing device includes a one-piece sealing member having an annular disc shape and being at least partially arranged within the radial annular groove. Such a configuration of the inter-stage sealing device, and particularly the fact that it is made in one-piece, simplifies its manufacturing and reduces the level of machining accuracy which is needed to manufacture it, while substantially reducing undesirable fluid leakage through the inter-stage sealing device and thus facilitating the control of the sealing between the two stages of the centrifugal turbo-compressor. Such a configuration of the inter-stage sealing device also reduces the cost for manufacturing the centrifugal turbo-compressor.

According to another embodiment of the invention, the centrifugal turbo-compressor further includes a labyrinth seal configured to minimize or control fluid flow from the second compression stage to the first compression stage, the labyrinth seal being formed by an inner peripheral surface of the inter-stage sealing device and a circumferential bottom surface of the radial annular groove.

According to another embodiment of the invention, the first and second aerodynamic members are fixed in rotation, i.e. rotationally stationary or in other words non-rotatable with respect to the hermetic casing.

According to an embodiment of the invention, the second aerodynamic member is configured to bear against an axial surface of the main casing portion.

These and other advantages will become apparent upon reading the following description in view of the drawing attached hereto representing, as non-limiting examples, embodiments of a centrifugal turbo-compressor according to the invention.

BRIEF DESCRIPTION OF THE DRAWINGS

The following detailed description of several embodiments of the invention is better understood when read in conjunction with the appended drawings being understood, however, that the invention is not limited to the specific embodiments disclosed.

DETAILED DESCRIPTION OF THE INVENTION

Figure 1:
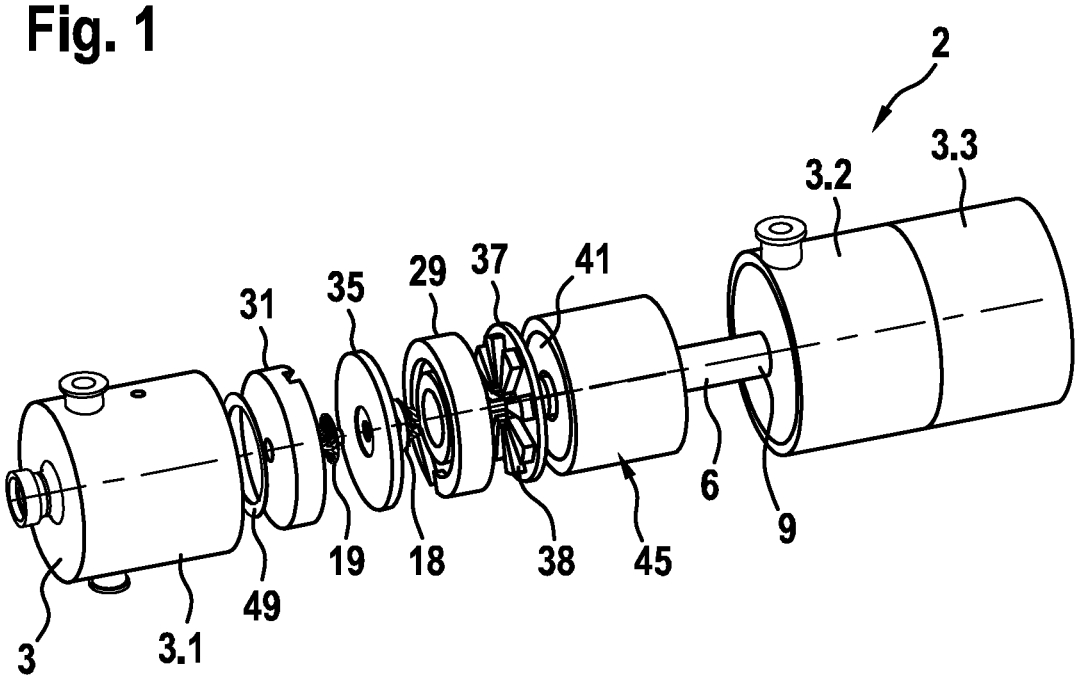
FIG. 1 is an exploded perspective view of a centrifugal turbo-compressor according to a first embodiment of the invention.
Figure 2:
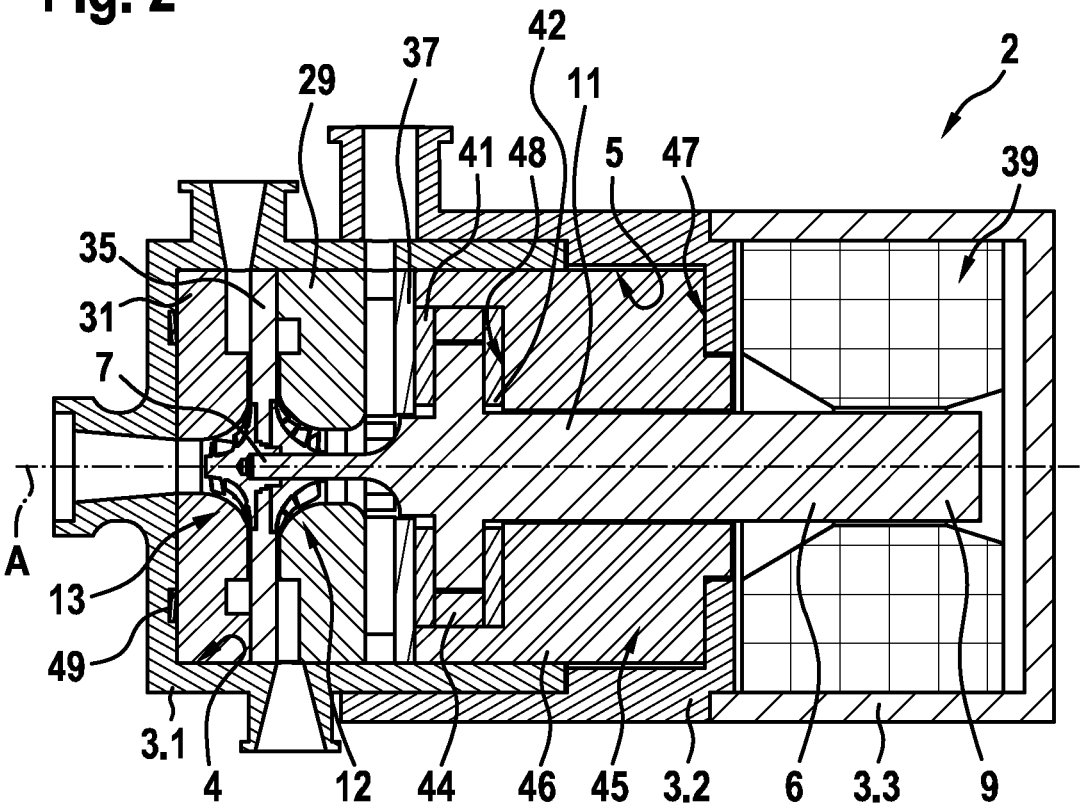
FIG. 2 is a longitudinal section view of the centrifugal turbo-compressor of FIG. 1.
Figure 3:
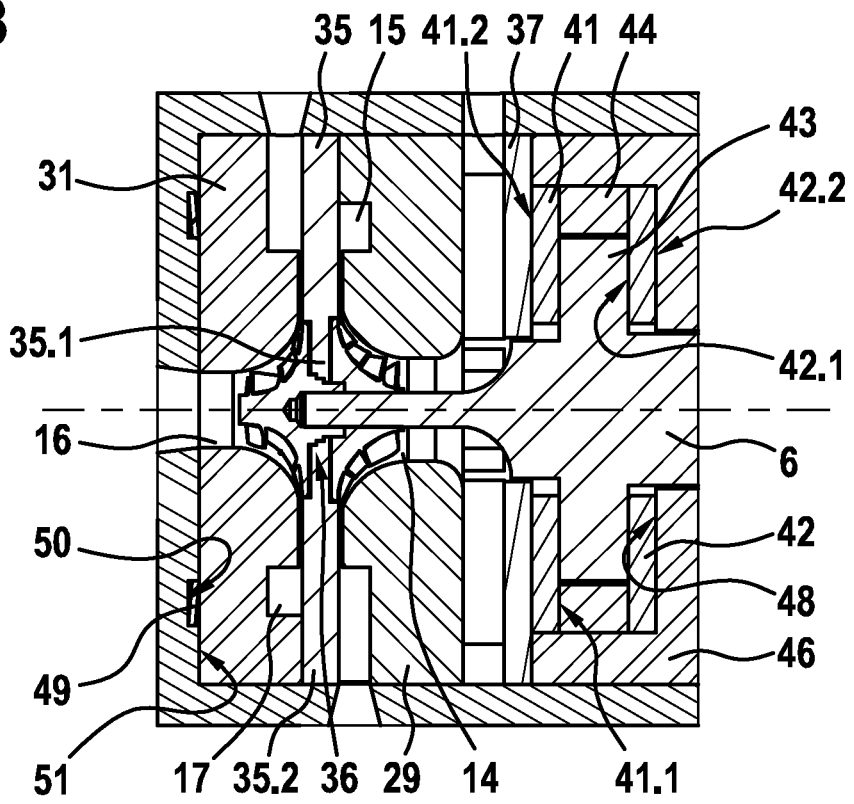
FIGS. 3 and 4 are partial longitudinal section view of the centrifugal turbo-compressor of FIG. 1.
Figure 4:
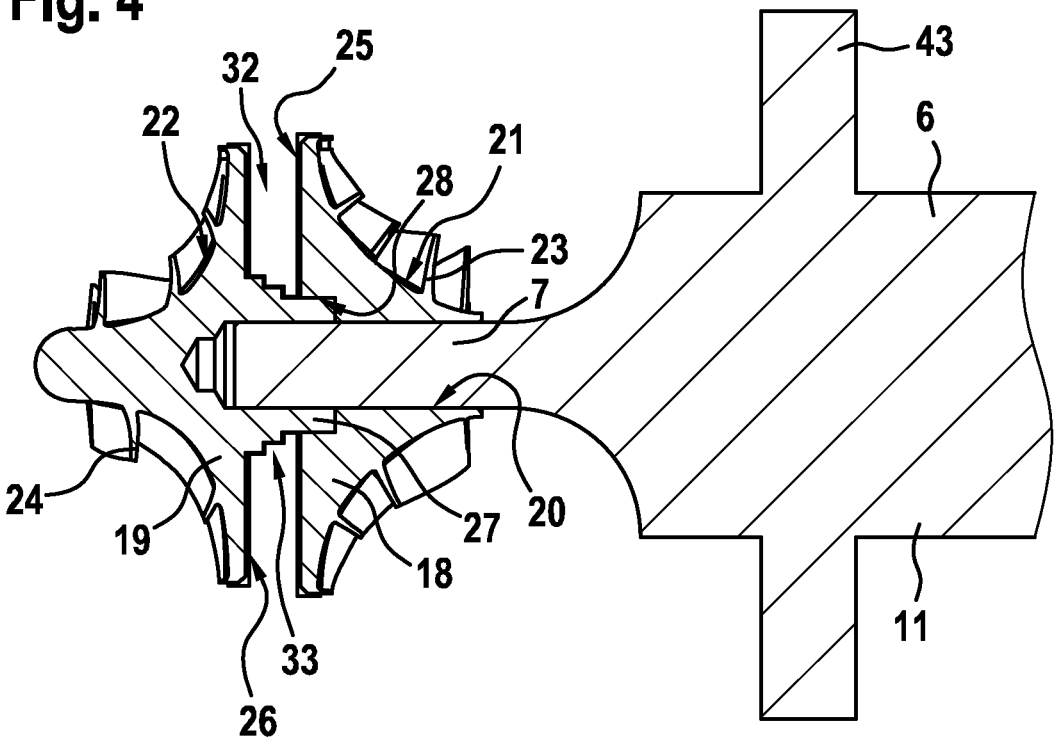

FIGS. 1 to 4 represent a hermetic centrifugal turbo-compressor 2, and particularly a double-stage hermetic centrifugal turbo-compressor, according to a first embodiment of the invention.

The centrifugal turbo-compressor 2 includes a hermetic casing 3 including a main casing portion 3.1, a bearing casing portion 3.2 and a motor casing portion 3.3. As better shown on FIG. 2, the main casing portion 3.1 and the bearing casing portion 3.2 respectively include a cylindrical main housing 4 and a cylindrical bearing housing 5 which extend coaxially. The main casing portion 3.1 and the bearing casing portion 3.2 are secured to each other, for example by screwing or welding.

The centrifugal turbo-compressor 2 also includes a drive shaft 6 rotatably arranged within the hermetic casing 3 and extending along a longitudinal axis A. The drive shaft 6 includes a first axial end portion 7, a second axial end portion 9 opposite to the first axial end portion 7, and an intermediate portion 11 arranged between the first and second end axial portions 7, 9.

The centrifugal turbo-compressor 2 further includes a first compression stage 12 and a second compression stage 13 arranged in the cylindrical main housing 4 and configured to compress a refrigerant. The first compression stage 12 includes a fluid inlet 14 and a fluid outlet 15, while the second compression stage 13 includes a fluid inlet 16 and a fluid outlet 17, the fluid outlet 15 of the first compression stage 12 being fluidly connected to the fluid inlet 16 of the second compression stage 13.

The first and second compression stages 12, 13 respectively include a first impeller 18 and a second impeller 19 which are connected to the first axial end portion 7 of the drive shaft 6 and which extend coaxially with the drive shaft 6. Particularly the first impeller 18 includes an axial bore 20 emerging in the front end of the first impeller 18 and configured to firmly receive the first axial end portion 7 of the drive shaft 6. According to the first embodiment of the invention, the axial bore 20 of the first impeller 18 extends along the entire axial length of the first impeller 18.

Each of the first and second impellers 18, 19 includes a front-side 21, 22 equipped with a plurality of blades 23, 24 configured to accelerate, during rotation of the drive shaft 6, the refrigerant entering the respective one of the first and second compression stages 12, 13, and to deliver the accelerated refrigerant to a diffuser arranged at the radial outside edge of the respective one of the first and second impellers 18, 19. Each of the first and second impellers 18, 19 also includes a back-side 25, 26 extending substantially perpendicularly to the drive shaft 6.

The first and second impellers 18, 19 are arranged in a back-to-back configuration, so that the directions of fluid flow at the flow inlet 14, 16 of the first and second compression stages 12, 13 are opposite to each other.

Advantageously, the second impeller 19 is distinct and separated from the first impeller 18 so as to enable notably an adjustment of the axial distance between the back-sides 25, 26 of the first and second impellers 18, 19 during assembly of the centrifugal turbo-compressor 2. According to the first embodiment of the invention, the second impeller 19 includes a tubular mounting portion 27 axially extending from the back-side 26 of the second impeller 19 and firmly and directly connected to the first end portion 7 of the drive shaft 6, for example by press-fit or shrink-fit. Further, according to the first embodiment of the invention, the first impeller 18 and the drive shaft 6 define an axial annular groove 28 emerging in the back-side 25 of the first impeller 18, and the tubular mounting portion 27 extends partially in the axial annular groove 28.

Further the first and second compression stage 12, 13 respectively includes a first aerodynamic member 29 and a second aerodynamic member 31 each having an annular disc shape. The first and second aerodynamic members 29, 31 respectively face the front-sides 21, 22 of the first and second impellers 18, 19. The outer diameters of the first and second aerodynamic members 29, 31 are substantially equal to the inner diameter of the cylindrical main housing 4. According to the first embodiment of the invention, the first and second aerodynamic members 29, 31 are axially slidably arranged in the cylindrical main housing 4.

The centrifugal turbo-compressor 2 also includes a radial annular groove 32 formed between the back-sides 25, 26 of the first and second impellers 18, 19. According to the first embodiment of the invention, the circumferential bottom surface 33 of the radial annular groove 32 is defined by the tubular mounting portion 27.

The centrifugal turbo-compressor 2 further includes an inter-stage sealing device arranged in the cylindrical main housing 4 and provided between the first and second impellers 18, 19. The inter-stage sealing device includes a one-piece sealing member 35 extending substantially perpendicularly to the drive shaft 6 and at least partially arranged within the radial annular groove 32. The one-piece sealing member 35 has an annular disc shape. The outer diameter of the one-piece sealing member 35 is substantially equal to the inner diameter of the cylindrical main housing 4, and the one-piece sealing member 35 is also axially slidably arranged in the cylindrical main housing 4.

The one-piece sealing member 35 comprises a central annular sealing portion 35.1 arranged within the radial annular groove 32 and an outer annular sealing portion 35.2 extending outside the radial annular groove 32. The central annular sealing portion 35.1 has a first axial wall surface and a second axial wall surface opposite to the first axial wall surface. Advantageously, the first axial wall surface of the central annular sealing portion 35.1 and the back-side 25 of the first impeller 18 define a first axial gap and the second axial wall surface of the central annular sealing portion 35.1 and the back-side 26 of the second impeller 19 define a second axial gap.

The centrifugal turbo-compressor 2 further includes a labyrinth seal 36 provided between the first and second compressor stages 12, 13 and in the radial annular groove 32. The labyrinth seal 36 is configured to minimize or control fluid flow across the labyrinth seal 36, and particularly from the second compression stage 13 to the first compression stage 12. The labyrinth seal 36 is advantageously formed by an inner peripheral surface of the one-piece sealing member 35 and the circumferential bottom surface 33 of the radial annular groove 32.

The labyrinth seal 36 may be formed, for example, by a succession of stationary steps formed on the inner peripheral surface of the one-piece sealing member 35, and by a succession of rotary steps formed on the circumferential bottom surface 33 of the radial annular groove 32.

The centrifugal turbo-compressor 2 further includes an inlet distributor 37 arranged in the cylindrical main housing 4 and configured to supply the first aerodynamic member 29, and thus the first compression stage 12, with refrigerant. The inlet distributor 37 is adjacent to the first aerodynamic member 29, and has an annular disc shape and an outer diameter substantially equal to the inner diameter of the cylindrical main housing 4. The inlet distributor 37 is advantageously axially slidably arranged in the cylindrical main housing 4. Particularly, the inlet distributor 37 includes inlet guide members 38 extending radially towards the drive shaft 6.

The centrifugal turbo-compressor 2 also includes an electric motor 39 configured to drive in rotation the drive shaft 6 about the longitudinal axis A.

The centrifugal compressor 2 further includes an axial bearing arrangement, also named thrust bearing arrangement, configured to limit an axial movement of the drive shaft 6 during operation. The axial bearing arrangement may be a fluid axial bearing arrangement, and for example a gas axial bearing arrangement.

The axial bearing arrangement includes a first axial bearing plate 41 and a second axial bearing plate 42 each having an annular disc shape, and being arranged in parallel. The first axial bearing plate 41 has a first surface 41.1 axially facing the second axial bearing plate 42 and a second surface 41.2 opposite to the first surface 41.1, while the second axial bearing plate 42 has a first surface 42.1 axially facing the first axial bearing plate 41 and a second surface 42.2 opposite to the first surface 42.1.

The radial inner portions of the first surfaces 41.1, 42.1 of the first and second axial bearing plates 41, 42 define a space in which extends a radial flange portion 43 of the drive shaft 6. Particularly, the first surfaces 41.1, 42.1 of the first and second axial bearing plates 41, 42 are respectively configured to cooperate with first and second axial end faces of the radial flange portion 43. According to an embodiment of the invention, an axial clearance is provided between the radial flange portion 43 of the drive shaft 6 and the first surfaces 41.1, 42.1 of the first and second axial bearing plates 41, 42. Such an axial clearance is for example in the range of 10 μm.

The axial bearing arrangement further includes a spacer ring 44 surrounding the radial flange portion 43 of the drive shaft 6, and being clamped between the first surfaces 41.1, 42.1 of the first and second axial bearing plates 41, 42 at radial outer portions of the first and second axial bearing plates 41, 42. The spacer ring 44 defines an axial distance between the first and second axial bearing plates 41, 42, said axial distance being slightly greater than the width of the radial flange portion 43.

The centrifugal turbo-compressor 2 also includes a radial bearing arrangement configured to rotatably support the drive shaft 6. The radial bearing arrangement includes a radial bearing 45 at least partially arranged in the cylindrical bearing housing 4. The radial bearing 45 extends around the drive shaft 6 and advantageously along the intermediate portion 11 of the drive shaft 6. The radial bearing 45 comprises notably a bearing sleeve 46 abutting against an annular axial bearing surface 47 of the bearing casing portion 3.2.

The bearing sleeve 46 includes an abutment surface 48 against which the second surface 42.2 of the second axial bearing plate 42 abuts. The abutment surface 48 is located at an axial end of the bearing sleeve 46, and extends transversally, and advantageously perpendicularly, to the longitudinal axis A of the drive shaft 6. Therefore the bearing sleeve 46 is clamped between the second axial bearing plate 42 and the axial bearing surface 47 of the bearing casing portion 3.2.

The centrifugal compressor 2 further includes an elastic element 49 arranged between the main casing portion 3.1 and the second aerodynamic member 31. Advantageously, the elastic element 49 is an annular spring washer, for example of the Belleville type, coaxially arranged with the drive shaft 6. The elastic element 49 is for example arranged in an annular recess 50 formed in an axial surface 51 of the main casing portion 3.1.

According to the first embodiment of the invention, the elastic element 49 axially biases the first and second aerodynamic members 29, 31, the inter-stage sealing device and the inlet distributor 37 with a predetermined force, for example in the range of 8000 to 10000 N, against the second surface 41.1 of the first axial bearing plate 41, and therefore also axially biases the second surface 42.2 of the second axial bearing plate 42 against the abutment surface 48 of the bearing sleeve 46, which abuts against the annular axial bearing surface 47 of the bearing casing portion 3.2.

The elastic element 49 allows, notably when a thermal expansion occurs in the centrifugal turbo-compressor 2, an axial sliding of the first and second aerodynamic members 29, 31, the inter-stage sealing device 32, the inlet distributor 37 and the axial bearing arrangement with respect to the hermetic casing 3, and thus avoids deformations of said parts which could lead to a shortened lifetime of the centrifugal turbo-compressor 2.

Figure 5:
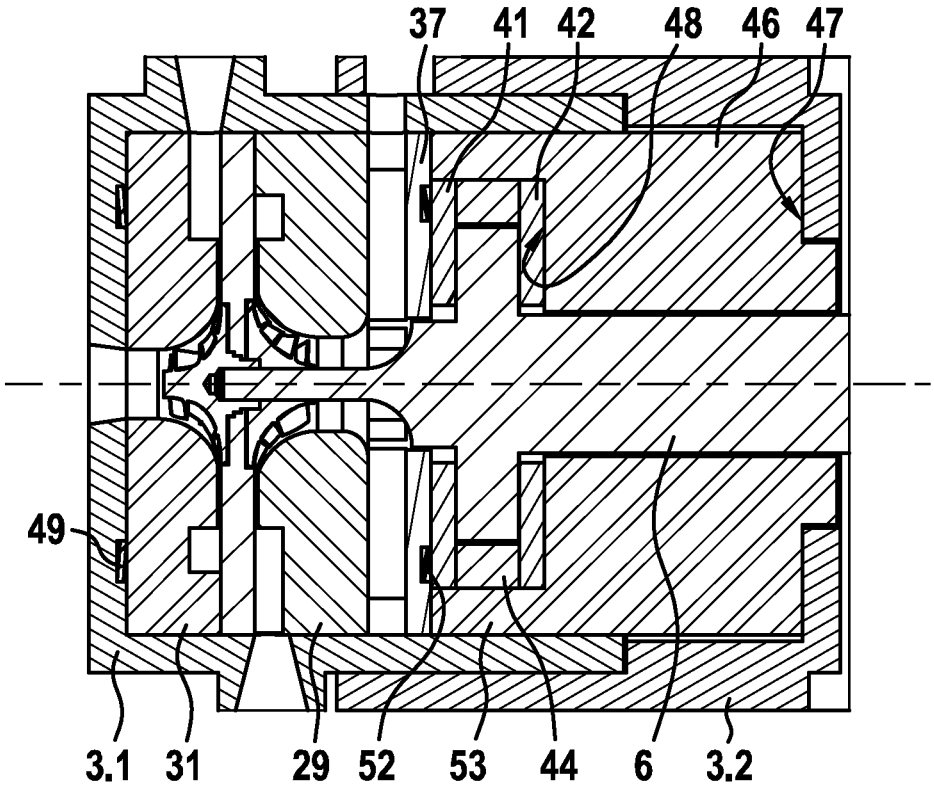
FIG. 5 is a partial longitudinal section view of a centrifugal turbo-compressor according to a second embodiment of the invention.

FIG. 5 represents a centrifugal turbo-compressor 2 according to a second embodiment of the invention which differs from the first embodiment notably in that it further includes an elastic member 52 axially biasing the first and second axial bearing plates 41, 42 and the spacer ring 44 with a predetermined force, for example in the range of 1000 to 2000 N, against the abutment surface 48 of the bearing sleeve 46. Advantageously, the elastic member 52 is an annular spring washer, for example of the Belleville type, coaxially arranged with the drive shaft 6. The elastic member 52 is for example arranged in an annular recess formed in an axial surface of the inlet distributor 37.

According to the second embodiment of the invention, the elastic element 49 axially bias the first and second aerodynamic members 29, 31, the inter-stage sealing device and the inlet distributor 37 with a predetermined force against an annular spacing part 53 of the bearing sleeve 46, which abuts against the annular axial bearing surface 47 of the bearing casing portion 3.2.

Further, according to the second embodiment of the invention, the inlet distributor 37 and the bearing sleeve 46 define an annular receiving chamber in which are axially slidably arranged the first and second axial bearing plates 41, 42 and the spacer ring 44.

Figure 6:
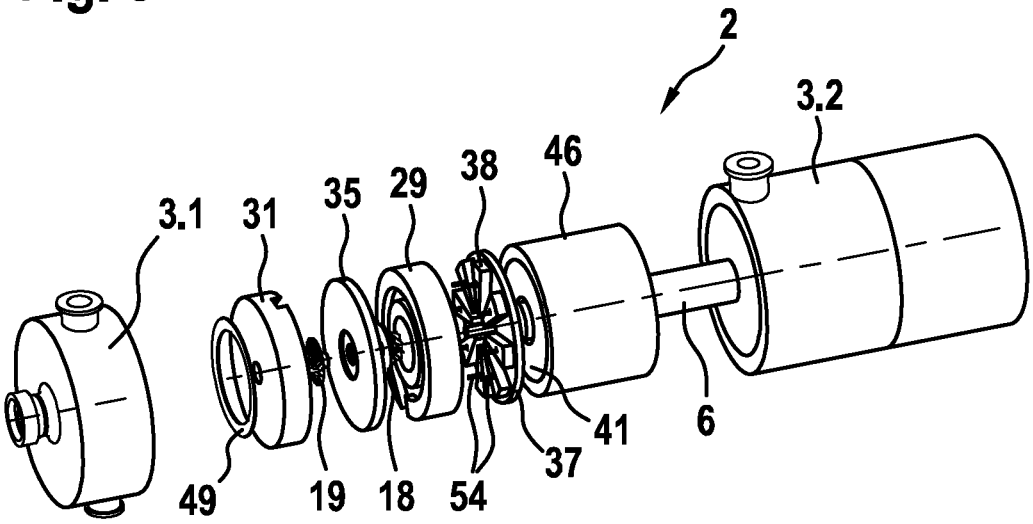
FIG. 6 is an exploded perspective section view of a centrifugal turbo-compressor according to a third embodiment of the invention.
Figure 7:
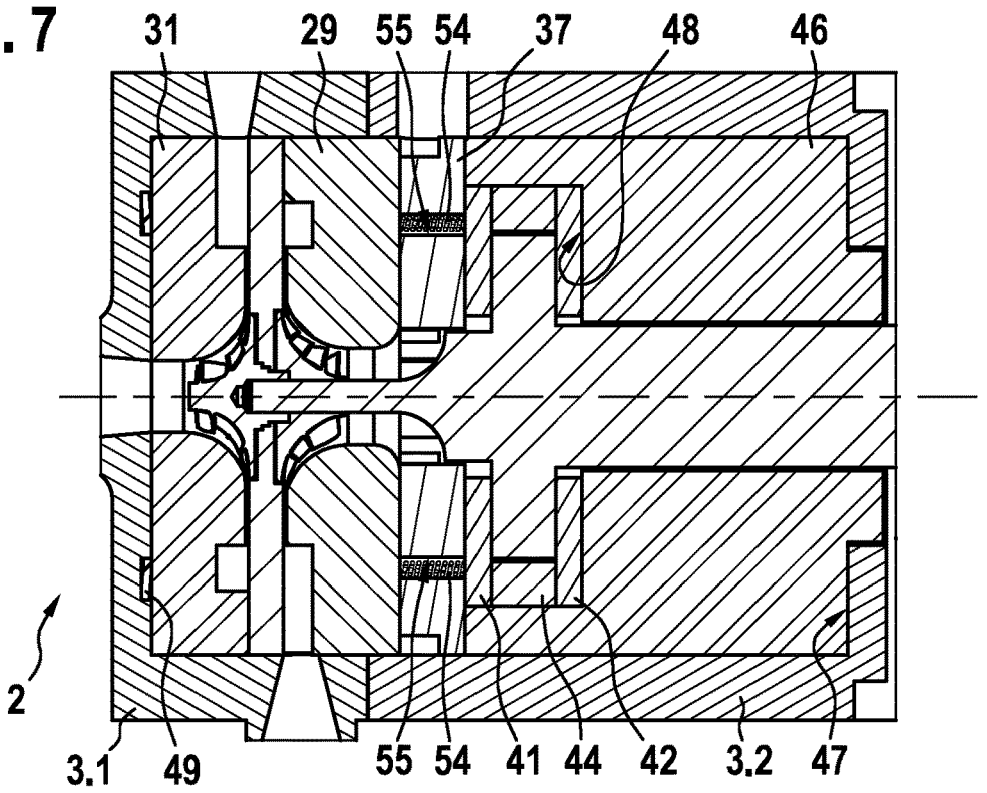
FIG. 7 is a partial longitudinal section view of the centrifugal turbo-compressor of FIG. 6.

FIGS. 6 and 7 represent a centrifugal turbo-compressor 2 according to a third embodiment of the invention which differs from the second embodiment particularly in that the first aerodynamic member 29 is secured to the bearing sleeve 46 for example by means of screws, and in that the centrifugal turbo-compressor 2 includes a plurality of coil springs 54 angularly arranged around the drive shaft 6 and axially biasing the first and second axial bearing plates 41, 42 and the spacer ring 44 with a predetermined force against the abutment surface 48 of the bearing sleeve 46.

According to the third embodiment of the invention, the coil springs 54 are located between the first aerodynamic member 29 and the first axial bearing plate 41. Advantageously, each coil spring 54 is arranged in a respective through hole 55 provided in the inlet distributor 37.

Further, according to the third embodiment of the invention, the elastic element 49 axially bias the second aerodynamic member 31 and the inter-stage sealing device with a predetermined force against an abutment surface provided on the first aerodynamic member 29, and therefore axially biases the first aerodynamic member 29 and the bearing sleeve 46 against the annular axial bearing surface 47 of the bearing casing portion 3.2.

Figure 8:
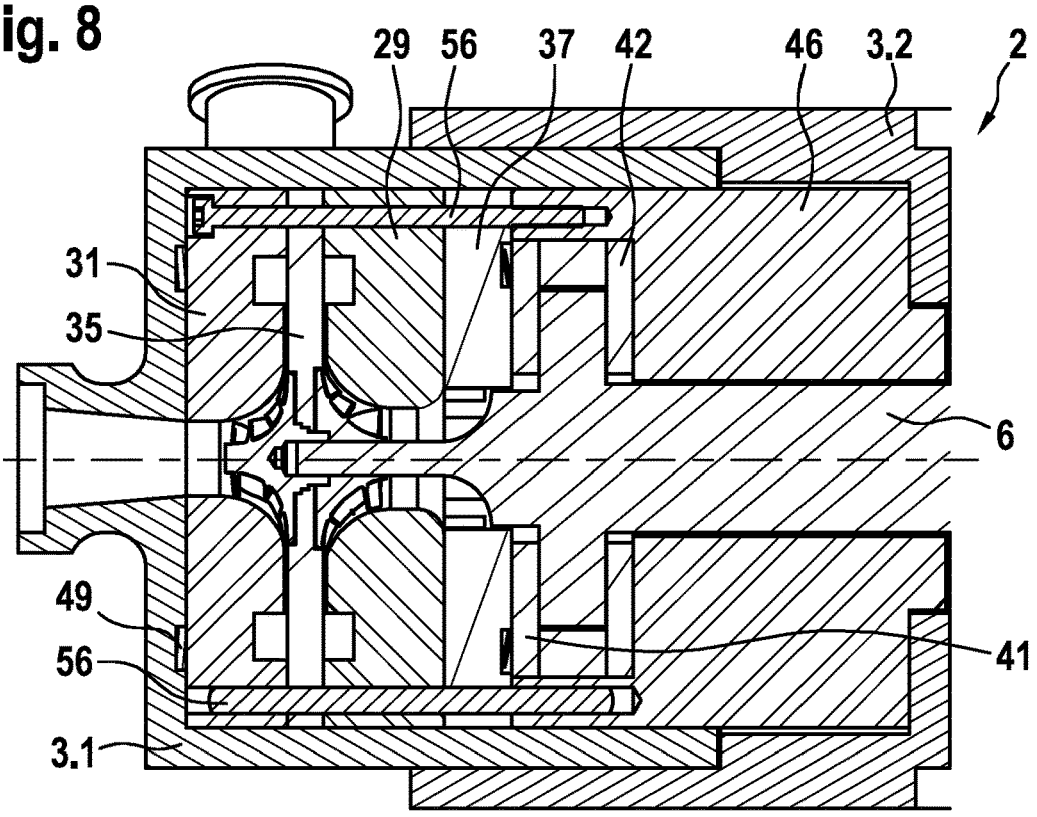
FIG. 8 is a partial longitudinal section view of the centrifugal turbo-compressor according to a fourth embodiment of the invention.

FIG. 8 represents a centrifugal turbo-compressor 2 according to a fourth embodiment of the invention which differs from the second embodiment particularly in that the first and second aerodynamic members 29, 31, the inter-stage sealing device 35 and the inlet distributor 37 are secured to the bearing sleeve 46, such that the first and second aerodynamic members 29, 31, the inter-stage sealing device 35, the inlet distributor 37 and the bearing sleeve 46 form a rigid sub-assembly.

Advantageously, the centrifugal turbo-compressor 2 may include several securing elements 56 configured to secure the first and second aerodynamic members 29, 31, the inter-stage sealing device 35 and the inlet distributor 37 to the bearing sleeve 46. For example, each securing element 56 may be a securing screw or a securing pin extending substantially parallely to the drive shaft 6. The securing element 56 may be angularly arranged around the drive shaft 6.

According to an embodiment of the invention, the securing elements 56 are configured to avoid a misalignment of the first and second aerodynamic members 29, 31, the inter-stage sealing device 35, the inlet distributor 37 and the bearing sleeve 46. However, the alignment of said different internal components can also be ensure by the hermetic casing 3.

Of course, the invention is not restricted to the embodiments described above by way of non-limiting examples, but on the contrary it encompasses all embodiments thereof.

The invention claimed is:

1. A centrifugal turbo-compressor (2) including:

a hermetic casing (3), a drive shaft (6) rotatably arranged within the hermetic casing (3), a radial bearing arrangement configured to rotatably support the drive shaft (6), a first compression stage and a second compression stage (12, 13) configured to compress a refrigerant, the first compression stage and the second compression stage (12, 13) respectively including a first impeller and a second impeller (18, 19), each of the first and second impellers (18, 19) having a front-side (21, 22) and a back-side (25, 26), the first and second impellers (18, 19) being connected to the drive shaft (6) and being arranged in a back-to-back configuration, and an inter-stage sealing device provided between the first and second impellers (18, 19), characterized in that the first compression stage and the second compression stage (12, 13) respectively include a first aerodynamic member and a second aerodynamic member (29, 31), the first and second aerodynamic members (29, 31) each having an annular disc shape and respectively facing the front-sides (21, 22) of the first and second impellers (18, 19), wherein the hermetic casing (3) includes a main casing portion (3.1) in which are arranged the first and second compression stages (12, 13) and the inter-stage sealing device, and wherein the hermetic casing (3) further includes a bearing casing portion (3.2) having an axial bearing surface (47), the radial bearing arrangement abutting against the axial bearing surface (47) of the bearing casing portion (3.2).

2. The centrifugal turbo-compressor (2) according to claim 1, wherein the first and second aerodynamic members (29, 31) and the inter-stage sealing device are secured to the radial bearing arrangement.

3. The centrifugal turbo-compressor (2) according to claim 1, further including an elastic element (49) arranged between the main casing portion (3.1) and the second aerodynamic member (31), the elastic element (49) axially biasing the first and second aerodynamic members (29, 31), the inter-stage sealing device and the radial bearing arrangement with a predetermined force against the axial bearing surface (47) of the bearing casing portion (3.2).

4. The centrifugal turbo-compressor (2) according to claim 3, wherein the elastic element (49) is arranged in an annular recess at least partially formed in an axial surface (51) of the main casing portion (3.1).

5. The centrifugal turbo-compressor (2) according to claim 1, wherein the radial bearing arrangement is at least partially arranged in the bearing casing portion (3.2).

6. The centrifugal turbo-compressor (2) according to claim 1, further including an axial bearing arrangement configured to limit an axial movement of the drive shaft (6) during operation, the axial bearing arrangement including:

a first axial bearing plate (41) having an annular disc shape, the first axial bearing plate (41) having a first surface (41.1) and a second surface (41.2) opposite to the first surface (41.1) of the first axial bearing plate (41), a second axial bearing plate (42) having an annular disc shape, the second axial bearing plate (42) having a first surface (42.1) axially facing the first axial bearing plate (41) and a second surface (42.2) opposite to the first surface (42.1) of the second axial bearing plate (42), a spacer ring (44) clamped between the first surfaces (41.1, 42.1) of the first and second axial bearing plates (41, 42) at radial outer portions of the first and second axial bearing plates (41, 42), the spacer ring (44) defining an axial distance between the first and second axial bearing plates (41, 42).

7. The centrifugal turbo-compressor (2) according claim 6, wherein the radial bearing arrangement includes a bearing sleeve (46) having an abutment surface (48), the second surface (42.2) of the second axial bearing plate (42) abutting against the abutment surface (48) of the bearing sleeve (46), and wherein the centrifugal turbo-compressor further includes at least one elastic member (52, 54) axially biasing the first and second axial bearing plates (41, 42) and the spacer ring (44) with a predetermined force against the abutment surface (48) of the bearing sleeve (46).

8. The centrifugal turbo-compressor (2) according to claim 1, further including an inlet distributor (37) having an annular disc shape and being adjacent to the first aerodynamic member (29), the inlet distributor (37) being configured to supply the first compression stage (12) with refrigerant.

9. The centrifugal turbo-compressor (2) according to claim 1, wherein the second impeller (19) is distinct and separated from the first impeller (18) so as to enable an adjustment of an axial distance between the back-sides (25, 26) of the first and second impellers (18, 19).

10. A centrifugal turbo-compressor (2) including:

a hermetic casing (3), a drive shaft (6) rotatably arranged within the hermetic casing (3), a radial bearing arrangement configured to rotatably support the drive shaft (6), a first compression stage and a second compression stage (12, 13) configured to compress a refrigerant, the first compression stage and the second compression stage (12, 13) respectively including a first impeller and a second impeller (18, 19), each of the first and second impellers (18, 19) having a front-side (21, 22) and a back-side (25, 26), the first and second impellers (18, 19) being connected to the drive shaft (6) and being arranged in a back-to-back configuration, an inter-stage sealing device provided between the first and second impellers (18, 19), and an axial bearing arrangement configured to limit an axial movement of the drive shaft (6) during operation, the axial bearing arrangement including:

a first axial bearing plate (41) having an annular disc shape, the first axial bearing plate (41) having a first surface (41.1) and a second surface (41.2) opposite to the first surface (41.1) of the first axial bearing plate (41), a second axial bearing plate (42) having an annular disc shape, the second axial bearing plate (42) having a first surface (42.1) axially facing the first axial bearing plate (41) and a second surface (42.2) opposite to the first surface (42.1) of the second axial bearing plate (42), a spacer ring (44) clamped between the first surfaces (41.1, 42.1) of the first and second axial bearing plates (41, 42) at radial outer portions of the first and second axial bearing plates (41, 42), the spacer ring (44) defining an axial distance between the first and second axial bearing plates (41, 42), characterized in that the first compression stage and the second compression stage (12, 13) respectively include a first aerodynamic member and a second aerodynamic member (29, 31), the first and second aerodynamic members (29, 31) each having an annular disc shape and respectively facing the front-sides (21, 22) of the first and second impellers (18, 19), wherein the hermetic casing (3) includes a main casing portion (3.1) in which are arranged the first and second compression stages (12, 13) and the inter-stage sealing device, and wherein the radial bearing arrangement includes a bearing sleeve (46) having an abutment surface (48), the second surface (42.2) of the second axial bearing plate (42) abutting against the abutment surface (48) of the bearing sleeve (46).

11. The centrifugal turbo-compressor (2) according to claim 10, wherein the first and second aerodynamic members (29, 31) and the inter-stage sealing device are secured to the radial bearing arrangement.

12. The centrifugal turbo-compressor (2) according to claim 10, wherein the hermetic casing (3) further includes a bearing casing portion (3.2) having an axial bearing surface (47), the radial bearing arrangement abutting against the axial bearing surface (47) of the bearing casing portion (3.2).

13. The centrifugal turbo-compressor (2) according to claim 12, further including an elastic element (49) arranged between the main casing portion (3.1) and the second aerodynamic member (31), the elastic element (49) axially biasing the first and second aerodynamic members (29, 31), the inter-stage sealing device and the radial bearing arrangement with a predetermined force against the axial bearing surface (47) of the bearing casing portion (3.2).

14. The centrifugal turbo-compressor (2) according to claim 13, wherein the elastic element (49) is arranged in an annular recess at least partially formed in an axial surface (51) of the main casing portion (3.1).

15. The centrifugal turbo-compressor (2) according to claim 12, wherein the radial bearing arrangement is at least partially arranged in the bearing casing portion (3.2).

16. The centrifugal turbo-compressor (2) according to claim 1, further including at least one elastic member (52, 54) axially biasing the first and second axial bearing plates (41, 42) and the spacer ring (44) with a predetermined force against the abutment surface (48) of the bearing sleeve (46).

17. The centrifugal turbo-compressor (2) according to claim 1, further including an inlet distributor (37) having an annular disc shape and being adjacent to the first aerodynamic member (29), the inlet distributor (37) being configured to supply the first compression stage (12) with refrigerant.

18. The centrifugal turbo-compressor (2) according to claim 1, wherein the second impeller (19) is distinct and separated from the first impeller (18) so as to enable an adjustment of an axial distance between the back-sides (25, 26) of the first and second impellers (18, 19).

* * * * *